US012098615B2

(12) United States Patent
Evans et al.

(10) Patent No.: US 12,098,615 B2
(45) Date of Patent: Sep. 24, 2024

(54) HYDROSTATICALLY INSENSITIVE PLUG ASSEMBLY

(71) Applicant: Weatherford Technology Holdings, LLC, Houston, TX (US)

(72) Inventors: Eric R. Evans, Houston, TX (US); Jobby T. Jacob, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/152,737

(22) Filed: Jan. 10, 2023

(65) Prior Publication Data

US 2024/0229599 A1 Jul. 11, 2024

(51) Int. Cl.

| | |
|---|---|
| ***E21B 33/16*** | (2006.01) |
| ***E21B 34/10*** | (2006.01) |
| ***E21B 47/117*** | (2012.01) |

(52) U.S. Cl.

CPC ..... *E21B 33/16* (2013.01); *E21B 34/101* (2013.01); *E21B 47/117* (2020.05); *E21B 2200/06* (2020.05)

(58) Field of Classification Search

CPC ..... E21B 33/16; E21B 33/165; E21B 33/167; E21B 34/101; E21B 2200/06

See application file for complete search history.

(56) References Cited

U.S. PATENT DOCUMENTS

| | | | | |
|---|---|---|---|---|
| 4,671,358 | A * | 6/1987 | Lindsey, Jr. | E21B 34/14 166/291 |
| 7,234,529 | B2 | 6/2007 | Surjaatmadja | |
| 8,807,227 | B2 | 8/2014 | Fould et al. | |
| 9,080,422 | B2 | 7/2015 | Melenyzer | |
| 9,273,534 | B2 | 3/2016 | Merron et al. | |
| 10,648,272 | B2 | 5/2020 | Budde et al. | |
| 10,954,740 | B2 | 3/2021 | Budde et al. | |
| 11,047,202 | B2 | 6/2021 | Budde et al. | |
| 11,047,227 | B1 | 6/2021 | Warlick | |
| 2003/0230405 | A1 | 12/2003 | Allamon et al. | |
| 2008/0251253 | A1* | 10/2008 | Lumbye | E21B 33/16 166/317 |
| 2012/0234561 | A1* | 9/2012 | Hall | E21B 23/02 166/386 |
| 2016/0208578 | A1 | 7/2016 | Guzman | |
| 2018/0112487 | A1* | 4/2018 | Budde | E21B 33/165 |
| 2019/0186228 | A1 | 6/2019 | Beckett et al. | |

* cited by examiner

*Primary Examiner* — David Carroll

(74) *Attorney, Agent, or Firm* — Peter V. Schroeder; Booth Albanesi Schroeder PLLC

(57) ABSTRACT

A plug assembly having valve chamber chargeable with pressure from above or below the plug assembly. The charged chamber is used to selectively move an external sleeve to open fluid communication between the tubular above and below the plug assembly.

20 Claims, 10 Drawing Sheets

HYDROSTATICALLY INSENSITIVE PLUG ASSEMBLY

CROSS-REFERENCE TO RELATED APPLICATIONS

None.

TECHNICAL FIELD

The present disclosure relates to plug assemblies for use in operations in a wellbore, and more particularly, for plug assemblies providing for pressure management in a chamber of the plug assembly during operation.

BACKGROUND

A wellbore is formed by using a drill bit on a drill string to drill through a geological formation. After drilling through the formation to a predetermined length or depth, the drill string and drill bit are removed, and the wellbore is lined with casing. To prevent the casing from moving within the wellbore, the casing annulus is filled with cement during a cementing operation. In addition to preventing the casing from moving within the wellbore, the cemented annulus also provides for a stronger wellbore for facilitation of hydrocarbon production.

When the casing is sent downhole, the casing is typically filled with a fluid, such as drilling mud, and the fluid is maintained at a predetermined pressure. The fluid within the casing ensures that the casing does not collapse within the wellbore. A bottom end of the casing can include a float assembly, such as a float collar or a float shoe. The float assembly includes one or more unidirectional check valves that allow fluid to pass from the casing to the annulus but prevents fluid from the annulus entering the casing. An upper end of the float assembly may also include a receptacle for receiving a device, such as a cement plug, that is run down the casing.

During a cementing operation, it is preferred that the various fluids, such as spacer fluid, cement, displacement fluid and the like, are isolated or separated from one another within the casing. When fluids such as drilling mud mix with cement, for example, it can cause the cement to sour and fail when it sets. Accordingly, one or more plugs can be sent down, separating the fluids during a cementing operation. A plug includes one or more fins around its circumference which act to separate the fluids above and below the plug. The fins also clean the inner walls of the casing as the plug descends. Because the plug provides both separation and cleaning functions, the outer diameter of the plug is approximately equal to the inner diameter of the casing and sealingly engages the casing. As the plug descends, the fluid below the plug is forced by the plug and the fluid behind it through a float assembly and out into the annulus. A check valve within the float assembly prevents the fluid from moving back into the casing.

Although plugs may be solid, blocking fluid flow through the casing, some plugs may include a longitudinal bore therethrough. The bore may be selectively and temporarily blocked by a rupture membrane or the like, radially positioned across the bore to prevent the fluids above and below the plug from comingling. Once the plug reaches the float assembly, hydrostatic pressure is built above the rupture membrane. At rupture pressure, the membrane ruptures allowing fluid flow through the bore of the plug, through the float assembly, and into the annulus.

Multiple plugs may be employed in a cementing operation. For example, a first plug may push a first fluid, located below the plug, out into the casing annulus, while a second plug pushes a second fluid, such as a spacer fluid or cement, out into the annulus. The plugs are typically pumped down using a displacement fluid, for example, drilling mud or the like. In some embodiments, the multiple plugs are locked together. Typically, one of the plugs forms a seal within the casing, preventing fluid from moving past the plug. Once the wellbore is sealed, the cement is given time to cure and set.

In a casing integrity test, the cemented casing is pressure tested by injecting a displacement fluid, such as drilling fluid, into the casing up to a desired internal casing pressure. Testing is typically performed with a plug blocking fluid flow at the bottom of the casing. After integrity testing, reestablishing fluid communication with the wellbore required drilling out the plug or running a casing perforation operation, both lengthy and costly processes.

Disclosed herein are exemplary plugs for selectively sealing a casing during cementing operations and pressure testing and allowing fluid communication thereafter.

BRIEF DESCRIPTION OF THE DRAWINGS

Drawings of the preferred embodiments of the present disclosure are attached hereto so that the embodiments of the present disclosure may be better and more fully understood.

DETAILED DESCRIPTION OF EMBODIMENTS

Figure 1:
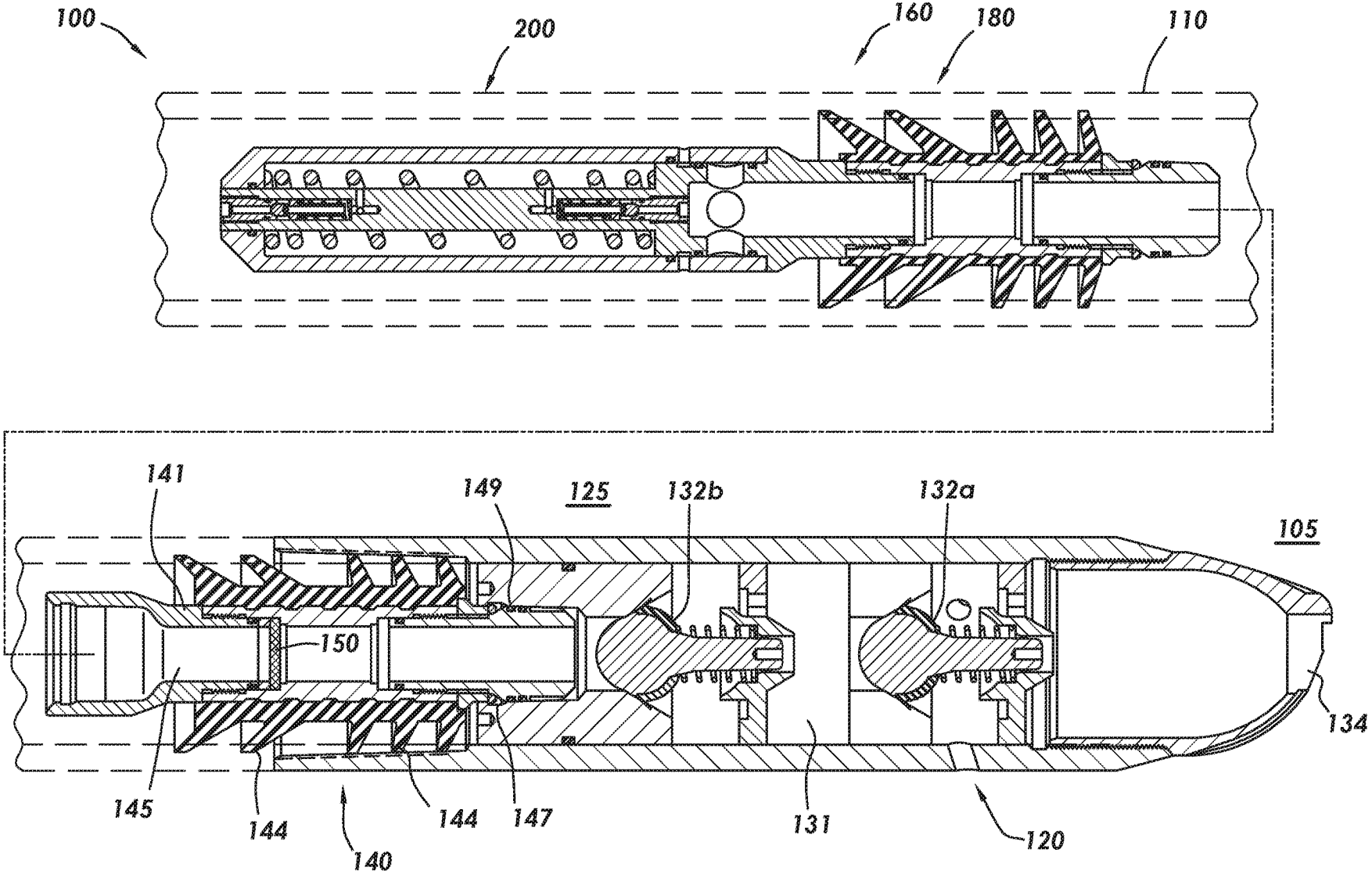
FIG. 1 is a side cross-sectional view of a plug and valve system for cementing or other downhole operations in a subterranean wellbore according to embodiments of the present disclosure.

FIG. 1 illustrates an embodiment of a system 100 for a cementing operation. A tubular, such as casing 110, has been lowered into a wellbore 105 and includes a collar assembly disposed at a lower end of the casing 110. The collar assembly may be a float assembly 120. The float assembly 120 includes a bore 131 and may include one or more valves 132A, 132B for controlling fluid flow through the bore 131. In one embodiment, the valves 132A, 132B are one-way valves configured to allow fluid to flow through the bore 131 and out of the casing 110, but prevent fluid re-entering the casing 110 through the bore 131. The fluid may flow out of the casing 110 through a port 134 at the bottom of the casing 110. In another embodiment, the collar assembly may be a landing collar, which may include a bore without a valve, such as the collar assembly shown in FIG. 7.

As shown, a first plug assembly 140 and a second plug assembly 160 are used to separate the fluids used in the cementing operation. For example, a first fluid may be disposed below the first plug assembly 140, a second fluid disposed between the first and second plug assemblies 140, 160, and a third fluid disposed above the second plug assembly 160. The fluids may be drilling fluids, cement, spacer fluids, displacement fluids and the like. In some embodiments, a first plug assembly separates the cement from a spacer fluid behind the cement while a second plug assembly separates the spacer fluid from a displacement fluid behind the spacer fluid. Additional plug assemblies may be used to separate additional fluids. For example, a third plug assembly may be used to separate the cement from a fluid in front of the cement. The terms "above" and "below, and "behind" and "in front," are used herein without respect to whether the wellbore is vertical or horizontal. For example, a fluid, tool or the like, said to be "above" or "behind" another is relatively closer to the wellhead, having entered the wellbore later, whether along a horizontal or vertical portion of the wellbore. As persons of skill in the art will understand, the disclosures herein are applicable in horizontal and vertical wells.

In one embodiment, the first plug assembly 140 includes a body 141 having a bore 145 extending through the body 141. A rupture disk 150 is positioned within the bore 145 and, when intact, blocks fluid flow through the bore 145. The rupture disk 150 is configured to break at a predetermined pressure. The first plug assembly 140 may include one or more fins 144 circumferentially positioned on the exterior surface of the body 141 for sealingly contacting the wall of the casing 110. The fins 144 act as a barrier to prevent comingling of fluids from above and below the first plug assembly 140. The fins 144 may clean the wall of the casing 110 as the plug 140 descends in the casing 110. A retaining mechanism 147 may be provided to attach to the float assembly 120. Suitable retaining mechanisms include a latch or a snap ring, for example. One or more sealing members 149, such as a o-rings, may be disposed between the first plug assembly 140 and the float assembly 120. It is contemplated the first plug assembly 140 may be any suitable cement plug known to a person of ordinary skill in the art.

When the first plug assembly 140 reaches the float assembly 120, fluid pressure may be increased within the bore sufficient to break the rupture disk 150. After the disk 150 breaks, the first plug bore 145 is open, allowing the fluid above the first plug assembly to flow through the first plug assembly 140, through the float assembly 120, and out to an annulus 125.

Figure 2:
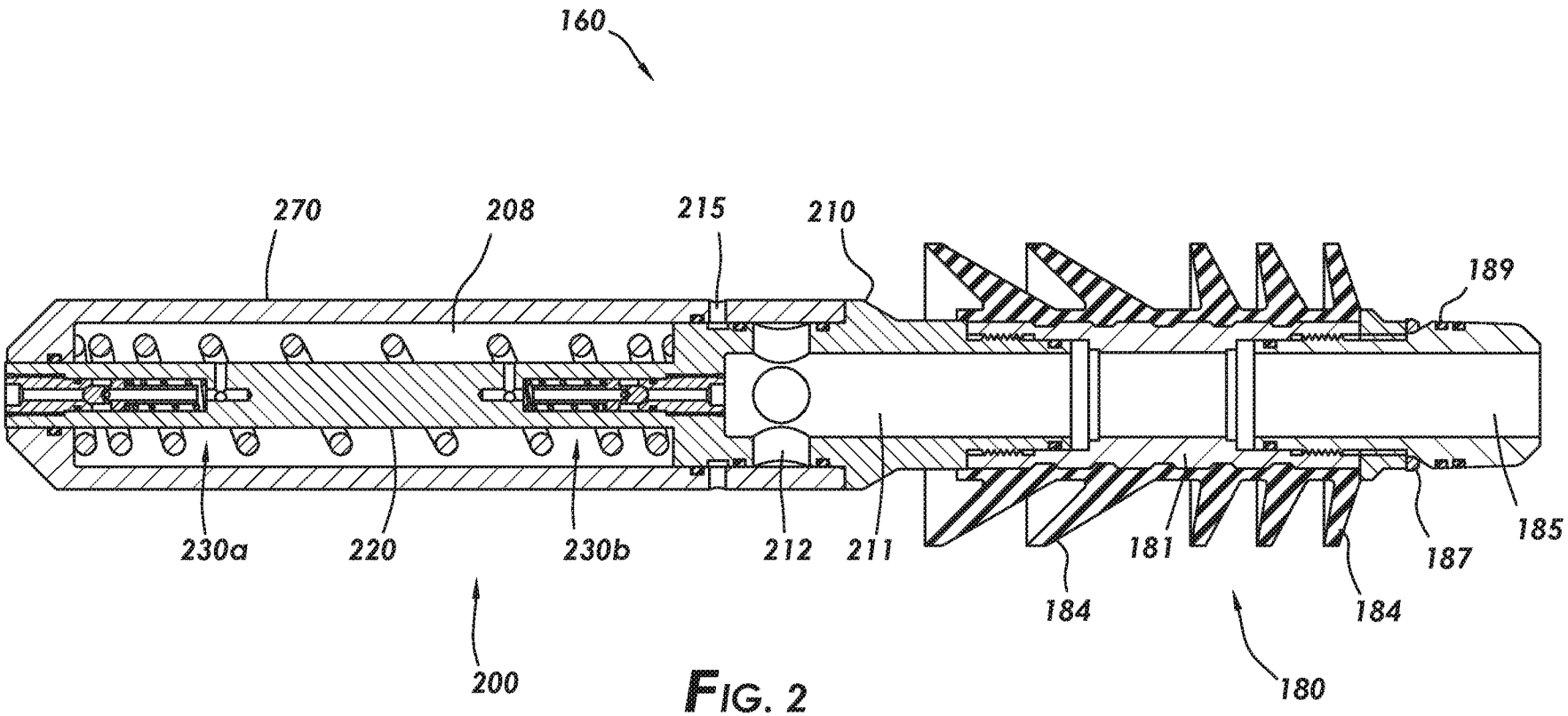
FIG. 2 is a side cross-sectional view of an exemplary plug assembly according to aspects of the disclosure.
Figure 3:
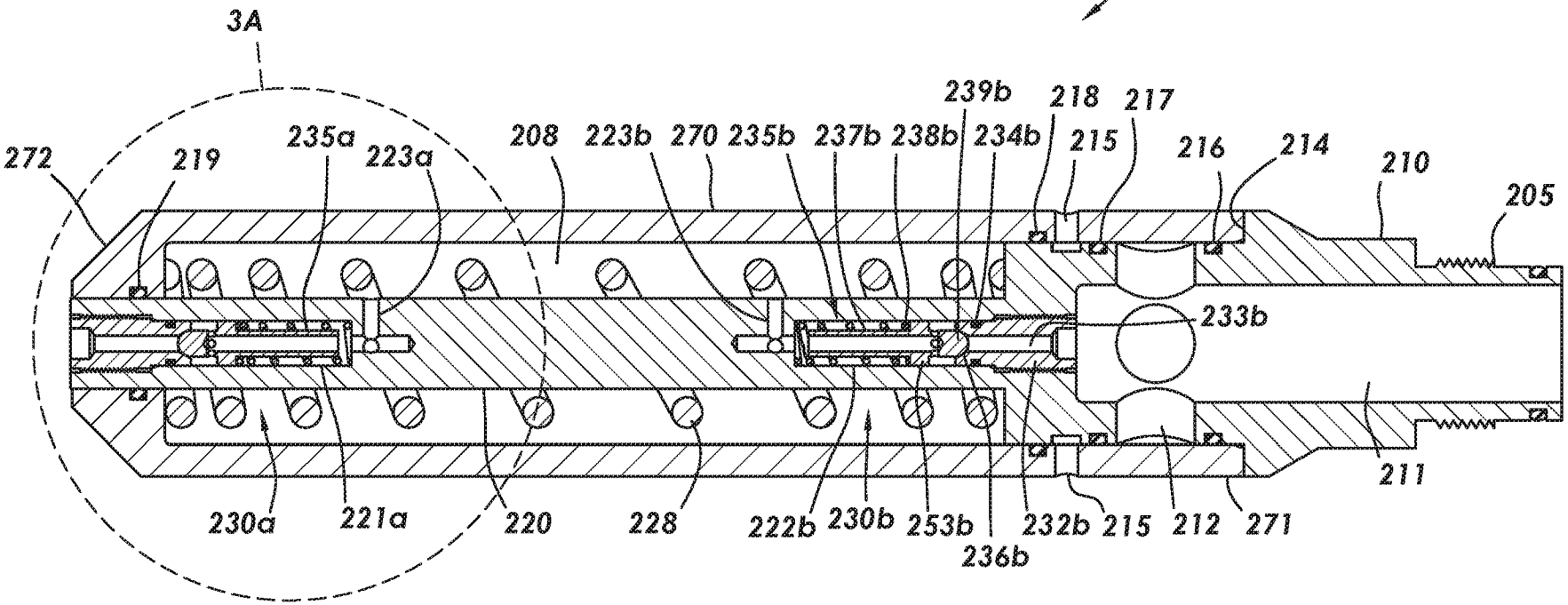
FIG. 3 is a side cross-sectional view of the valve unit of the plug assembly of FIG. 2.
Figure 3A:
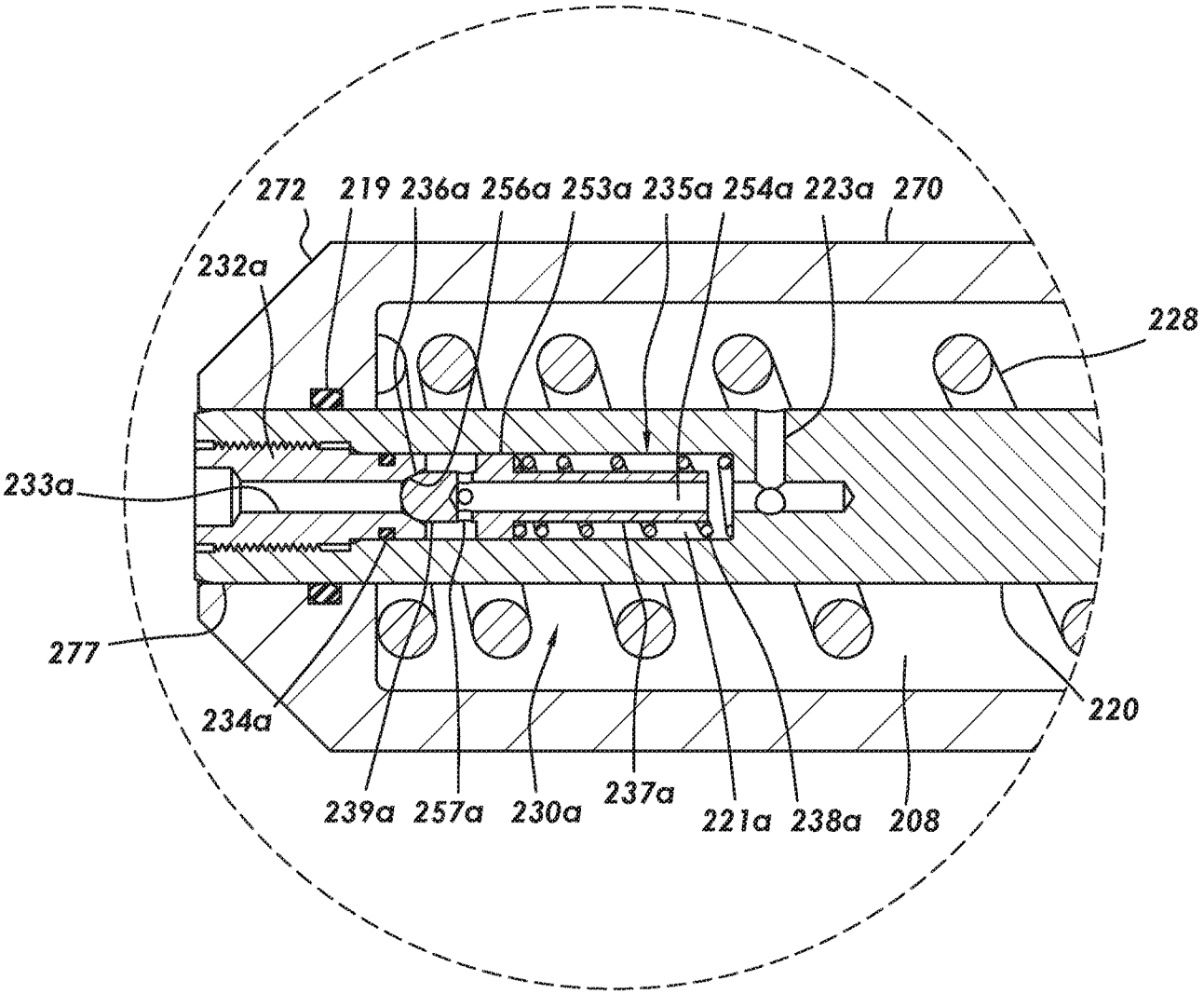
FIG. 3A is an enlarged partial view of the valve unit of FIG. 3.

The second plug assembly 160 travels behind the first plug assembly 140. The second plug assembly 160 may be released from the surface or a subsurface location. In one embodiment, the second plug assembly 160 includes a valve unit 200 coupled to a plug unit 180, as shown in FIGS. 1 and 2. FIG. 3 shows the valve unit 200, and FIG. 3A is an enlarged partial view of the valve unit 200. The plug unit 180 includes a body 181 having a bore 185 extending through the body 181. The plug unit 180 may include one or more fins 184 circumferentially positioned on the exterior surface of the body 181 for sealingly contacting the wall of the casing 110. The fins 184 act as a barrier to prevent comingling of fluids from above and below the plug unit 180. The fins 184 may clean the wall of the casing 110 as the plug unit 180 descends in the casing 110. A retaining mechanism 187 may be provided for attachment to the first plug assembly 140. Suitable retaining mechanisms include a latch or a snap ring, for example. One or more sealing members 189, such as o-rings, may be disposed between the plug unit 180 and the first plug assembly 140.

In one embodiment, the valve unit 200 is attached to the upper end of the plug unit 180. Referring to FIGS. 2, 3, and 3A, the valve unit 200 includes a valve body 210 coupled to an external sleeve 270. The valve body 210 has a connection end 205 for connection with the plug unit 250, and a stem extension 220. The valve body 210 includes an axial bore 211 open to the connection end 205. One or more ports 212 are formed through the wall of the valve body 210 and are in fluid communication with the bore 211. The valve body 210 has an outer diameter that is larger than an outer diameter of the stem extension 220. In some embodiments, the valve unit 200 is integrated with the plug unit 180.

The external sleeve 270 has a lower portion 271 disposed around a portion of the valve body 210 and an upper portion 272 disposed around a portion of the stem extension 220. The lower portion 271 has an inner diameter sized to accommodate the valve body 210. The end of the lower portion 271 may optionally engage a shoulder 214 formed on the valve body 210. One or more shearable members 215 may be used to attach the external sleeve 270 to the valve body 210. Suitable shearable members 215 include shear pins, shear screws, and snap rings. A plurality of sealing members 216, 217, 218 are disposed between the external sleeve 270 and the valve body 210 to limit fluid communication therebetween. In this embodiment, a scaling member 216, 217 is disposed on each side of the port 212. Sealing members 217, 218 are located on each side of the one or more shearable members 215. An exemplary sealing member is an o-ring. The upper portion 272 includes an opening 277 sized to accommodate the stem extension 220. A scaling member 219 is disposed in the opening 277 and between the external sleeve 270 and the stem extension 220 to limit fluid communication therebetween.

A chamber 208 is formed between the external sleeve 270 and the valve body 210. In this example, an annular chamber 208 is defined between the external sleeve 270 and the stem extension 220 of the valve body 210. The annular chamber 208 fluidly communicates with the upper stem bore 221 and the lower stem bore 222 via the upper port 223*a* and the lower port 223*b*, respectively. In some embodiments, the upper stem bore is connected to the lower stem bore, and the upper and lower stem bores can fluidly communicate with the annular chamber 208 using a single port, although additional ports may be used. A biasing member 228, such as a spring, is disposed in the annular chamber 208. In this embodiment, the lower end of the biasing member 228 engages valve body 210, and the upper end of the biasing member 228 engages the external sleeve 270. The biasing member 228 is arranged to urge the external sleeve 270 axially away from the valve body 210.

The valve unit 200 may include two opposing valve sub-assemblies 230*a* and 230*b*. The valve sub-assemblies function as one-way valves. Both valve sub-assemblies are seen in FIG. 3, positioned opposing one another in the valve unit 200. A detail of the upper valve sub-assembly 230*a* is seen in FIG. 3A.

An upper valve sub-assembly 230*a* includes a seat sleeve 232*a* configured to engage a seal piston 235*a*. The seat sleeve 232*a* is disposed in the upper portion of the upper stem bore 221*a* and may be threadedly connected to the upper stem bore 221*a* or attached using other suitable mechanisms such as a lock ring. A bore 233*a* extends through the seat sleeve 232*a* and provides fluid communication between the lower portion of the upper stem bore 221*a* and the bore of the casing 110 above the upper valve sub-assembly 230*a* when the seal piston 235*a* is in an open position. A sealing member 234*a*, such as an o-ring, is disposed between the seat sleeve 232*a* and the stem extension 220*a*. The lower end of the seat sleeve 23*a*2 includes a sealing surface 236*a* configured to sealingly engage a sealing surface 256*a* of the seal piston 235*a*. In some embodiments, the sealing surfaces 236*a*, 256*a* are arcuate in shape. In some embodiments, the upper valve sub-assembly 230*a* is disposed in the external sleeve 270 instead of the stem extension 220.

The seal piston 235*a* includes a head portion 239*a* and a tubular body 237*a*. The head portion 239*a* includes the sealing surface 256*a* for engaging the sealing surface 236*a* of the seat sleeve 232*a*. The tubular body 237*a* has an outer diameter smaller than the inner diameter of the upper stem bore 221*a*. The tubular body 237*a* includes an enlarged outer diameter portion 253*a* engaged with stem extension 220*a*. A biasing member 238*a*, such as a spring, is disposed in the annular area between the stem extension 220*a* and the tubular body 237*a*. In this embodiment, the lower end of the biasing member 238*a* engages the stem extension 220*a*, and the upper end of the biasing member 238*a* engages the enlarged portion 253*a*. The biasing member 238*a* is configured to urge the seal piston 235*a* upward toward the seat sleeve 232*a*. The tubular body 237*a* includes a bore 254*a* extending from the lower end of the tubular body 237*a* to the head portion 239*a*. The bore 25*a*4 provides fluid communication axially through the enlarged portion 253*a*. One or more ports 257*a* provide fluid communication between the upper end of the bore 254*a* and the annular area above the upper end of the enlarged portion 253*a*.

The lower valve sub-assembly 230*b* is similarly arranged as the upper valve sub-assembly 230*a*. Referring to FIG. 3, the seat sleeve 232*b* is disposed in the lower portion of the lower stem bore 222*b* and may be threadedly connected to the lower stem bore 222*b*. The bore 233*b* of the seat sleeve 23*b*2 provides fluid communication between the upper portion of the lower stem bore 22*b*2 and the bore 211*b* of the valve body 210*b*, which in turn communicates with the casing below the lower valve sub-assembly 230*b*. The seal piston 235*b* is configured to seal against fluid communication from below, for example, from the bore 211 of the valve body 210. In this respect, the biasing member 238*b*, such as a spring, is configured to urge the seal piston 235*b* downward toward the seat sleeve 232*b*. In comparison, the seal piston 235*a* of the upper valve sub-assembly 230*a* is biased in the opposite direction. The bore of the tubular body 237*b* extends from the lower port 224*b* to the head portion 239*b* of the lower piston 235*b* and is selectively in communication with the seat sleeve bore 233*b* and bore 211 when the piston 235*b* is in an open position.

When pressure is communicated through the upper valve sub-assembly into the chamber 208, the increase in pressure also serves to bias the lower valve sub-assembly 230*b* into the closed position. The opposite is true where pressure is communicated into the chamber through the lower valve sub-assembly. In some embodiments, the upper valve sub-assembly 230*a* and the lower valve sub-assembly 230*b* are configured to open at the same pressure differentials. Alternatively, the valve sub-assemblies can be constructed to open at different pressure differentials. For example, the spring 238*a* of the upper valve sub-assembly 230*a* may have a different biasing force than the spring 238*b* of the lower valve sub-assembly 230*b*.

Referring back to FIG. 1, as the second plug assembly 160 travels downward in the casing 110 toward the first plug assembly 140, the pressure in the annular chamber 208 equalizes with the pressure above or below the second plug assembly 160 via the valve sub-assemblies 230*a* and 230*b*. If the pressure below, or in "front" of, the second plug assembly 160 is higher than the pressure in the annular chamber 208 (plus the force of the bias spring 208), then pressure in the annular chamber 208 is increased to equalize with the pressure below the second plug assembly 160. For example, a higher pressure below the second plug assembly 160 will be communicated through the bore 211 of the lower valve sub-assembly 230*b*. The higher pressure causes the seal piston 235*b* to unseat from the seal sleeve 232*b*, thereby opening the lower valve sub-assembly 230*b* for fluid communication. The fluid pressure then communicates through ports 257*b*, bore 254*b*, and lower port 223*b* to the annular chamber 208. The pressure in the annular chamber 208 increases until the pressure differential is insufficient to maintain the seal piston 235*b* in the open position. In one example, the seal piston 235*b* closes when the pressure below is less than the pressure in the annular chamber 208 and the biasing force of the spring 238.

If the pressure above, or "behind." the second plug assembly 160 is higher than the pressure in the annular chamber 208, then pressure in the annular chamber 208 is increased to equalize the pressure above the second plug assembly 160. For example, the higher pressure above the second plug assembly 160 may be communicated through the bore 233*a* of the seat sleeve 232*a*. The higher pressure causes the seal piston 235*a* to unseat from the seal sleeve 232*a*, thereby opening the upper valve sub-assembly 230*a* for fluid communication. The fluid pressure then communicates through ports 257*a*, bore 254*a*, and upper port 223*a* to annular chamber 208. The pressure in the annular chamber 208 increases until the pressure differential is insufficient is maintain the seal piston 235*s* in the open position. In one example, the seal piston 235*s* closes when the pressure above drops to the pressure in the annular chamber 208 and the biasing force of the spring 238. In this respect, the second plug assembly 160 is configured to increase its internal pressure to that of the external pressure, either above or below. The pressure is retained in the chamber and may be used for a later downhole operation, such as releasing the external sleeve, as discussed below.

Figure 4:
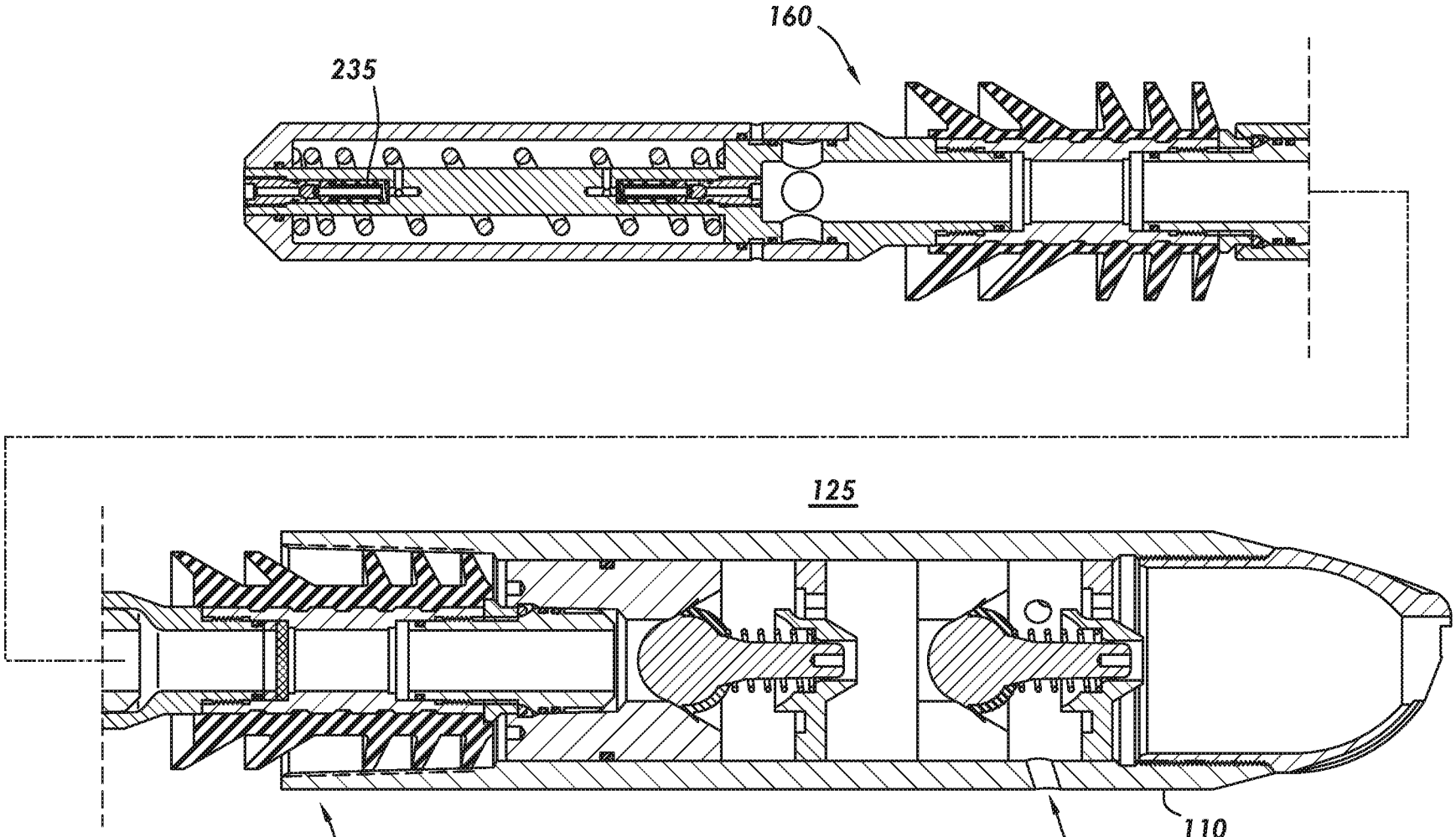
FIG. 4 is a side cross-sectional view of the plug assembly of FIG. 2 landed on a first plug assembly and float shoe, according to aspects of the disclosure.

The second plug assembly 160 will travel down the casing 110 until it lands on the first plug assembly 140, as shown in FIG. 4. In this position, the second plug assembly 160 has pushed the fluid between the first and second plug assemblies out of the casing 110 and into the annulus 125. Upon landing, the pressure above the second plug assembly 160, also referred to as the bump pressure, may be the same as the pressure in the annular chamber 208.

In some instances, after cementing a casing integrity test may be performed to test the integrity of the casing 110. The test begins by increasing the pressure in the casing 110 above the second plug assembly 160 until it reaches a predetermined test pressure. Because the test pressure is higher than the bump pressure, the pressure in the annular chamber 208 will increase to the test pressure.

Figure 5:
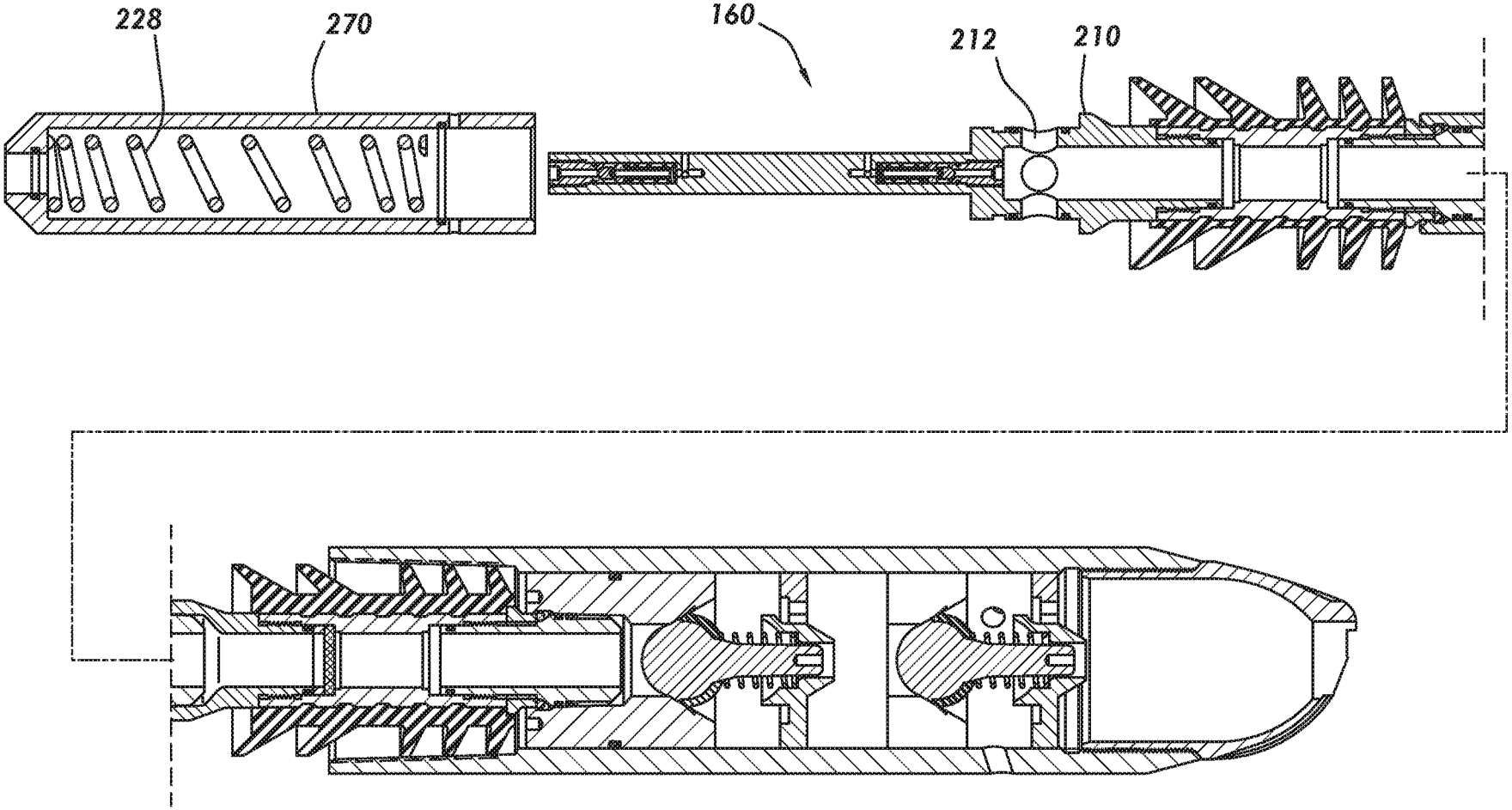
FIG. 5 is a side cross-sectional view of the system of FIG. 1 after removal of an external sleeve of the plug assembly of FIG. 2.

At the end of the test, test pressure is bled-off from above. As the pressure above decreases, a pressure differential is created between the higher pressure in the chamber and the lower pressure above. The pressure differential increases until it creates a piston effect sufficient to break the shearable members 215 attaching the external sleeve 270 to the valve body 210. The shearable members 215 may be shearable only in one direction, such as here, where the sleeve 270 is supported from below at shoulder 214. The external sleeve 270 is released from the valve body 210 to an open position, as shown in FIG. 5, wherein the ports 212 are open. The spring 228 in the annular chamber 208 may facilitate detachment of the external sleeve 270 from the valve body 210. In the open position, the second plug assembly 160 allows continued operations requiring communication of fluid or pressure through the bottom of the casing, such as injection operations, for example.

Figure 6:
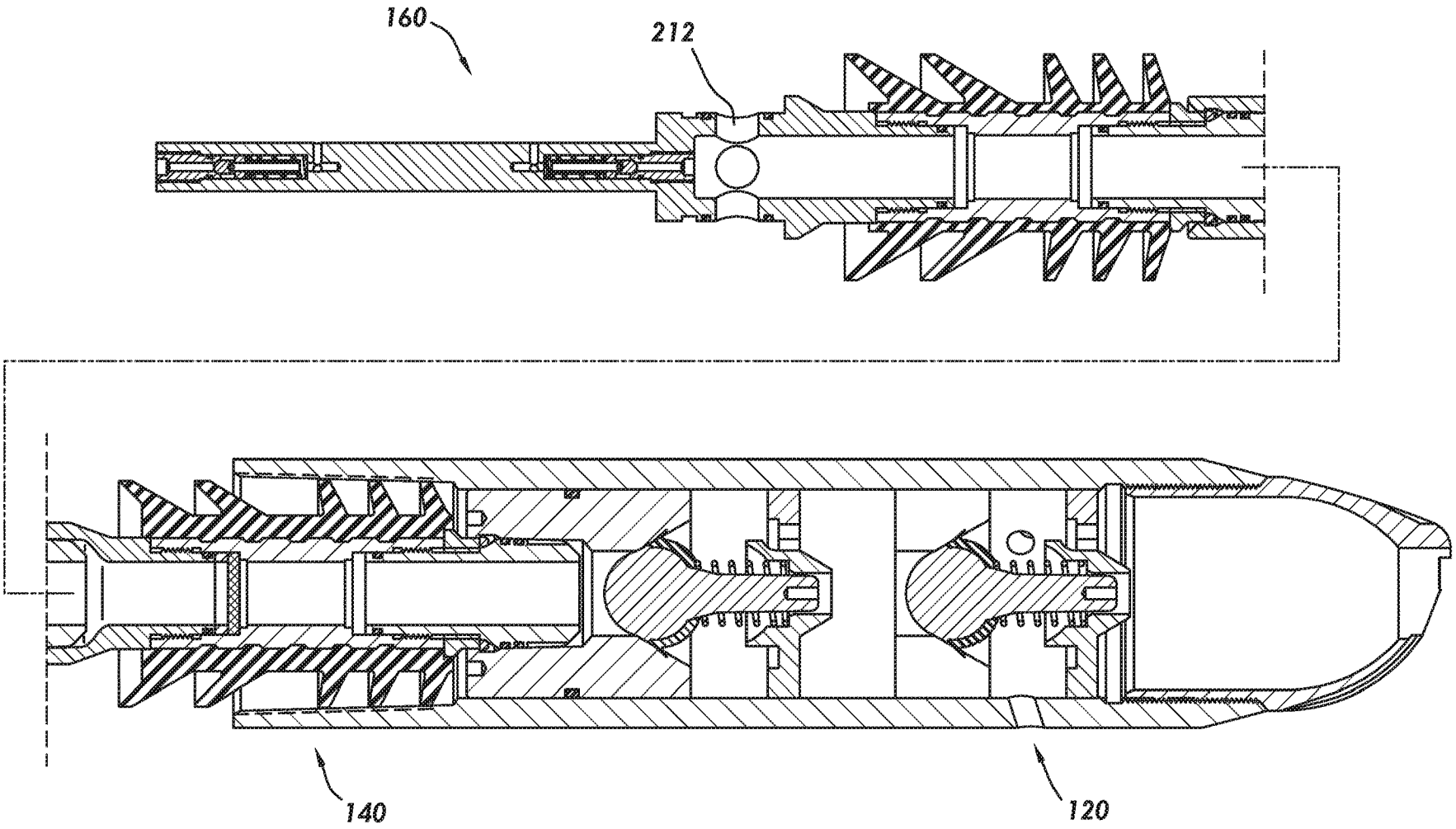
FIG. 6 is a side cross-sectional view of the system of FIG. 1 ready for an injection operation.

FIG. 6 shows the second plug assembly 160 after removal of the external sleeve 270 from the valve body. In some embodiments, the sleeve 270 can be moved to the open position but retained on the valve body. For example, see the embodiments herein at FIGS. 8-9. The sleeve can move axially to open the radial ports 212. In some embodiments, the sleeve moves axially to open the chamber 208, releasing the pressure therein.

In another embodiment, the second plug assembly 160 may be used without the first plug assembly 140. For example, the second plug assembly 160 may land directly into the float collar 120.

Figure 7:
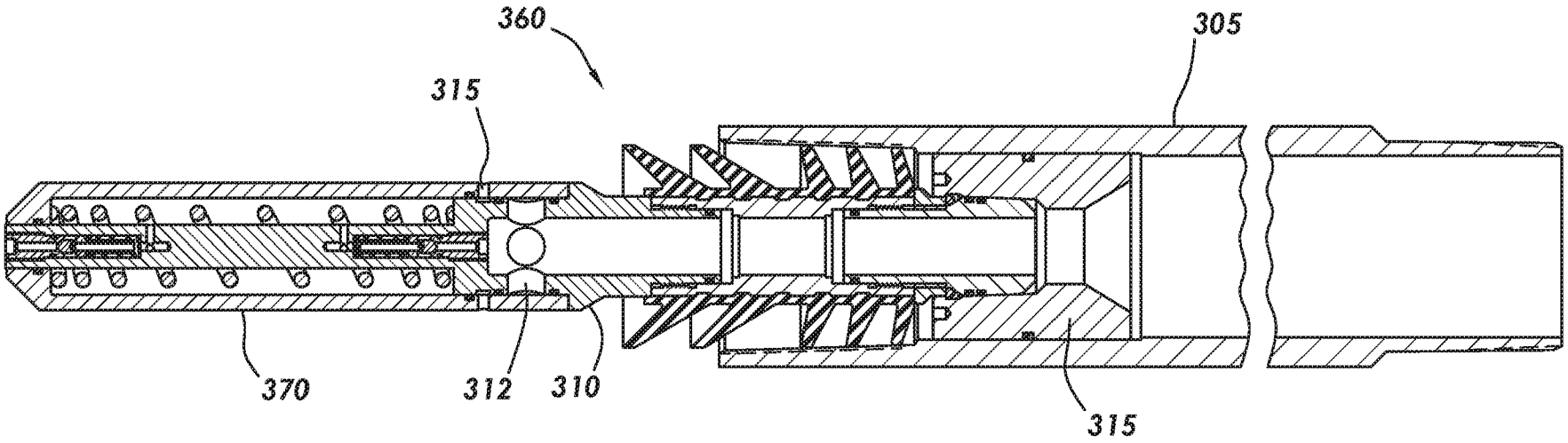
FIG. 7 is a side cross-sectional view of an exemplary valve unit and plug assembly according to aspects of the disclosure.

The second plug assembly 160 may be used for downhole operations other than cementing operations. For example, the plug assembly 360 may be used as a floatation plug assembly, as shown in FIG. 7. The plug assembly 360 is attached to a seat 315 in a casing 305. The lower end of the casing 305 may include a float collar (not shown)) such as float collar 120 shown in FIG. 1. A lower density fluid, such as air, is disposed between the float collar and the plug assembly 360. The lower density may reduce, e.g., "lighten," the weight of the casing 305 relative to the fluid in the wellbore, thereby facilitating movement of the casing 305 in the wellbore. After the casing 305 reaches the desired location, the plug assembly 360 may be opened for fluid communication. For example, pressure above the plug assembly 360 is increased until the pressure differential with the pressure in the annular chamber 308 is sufficient to shear the shearable members 315. Thereafter, the external sleeve 370 is released from the valve body 310, thereby opening the ports 312 for fluid communication.

Figure 8:
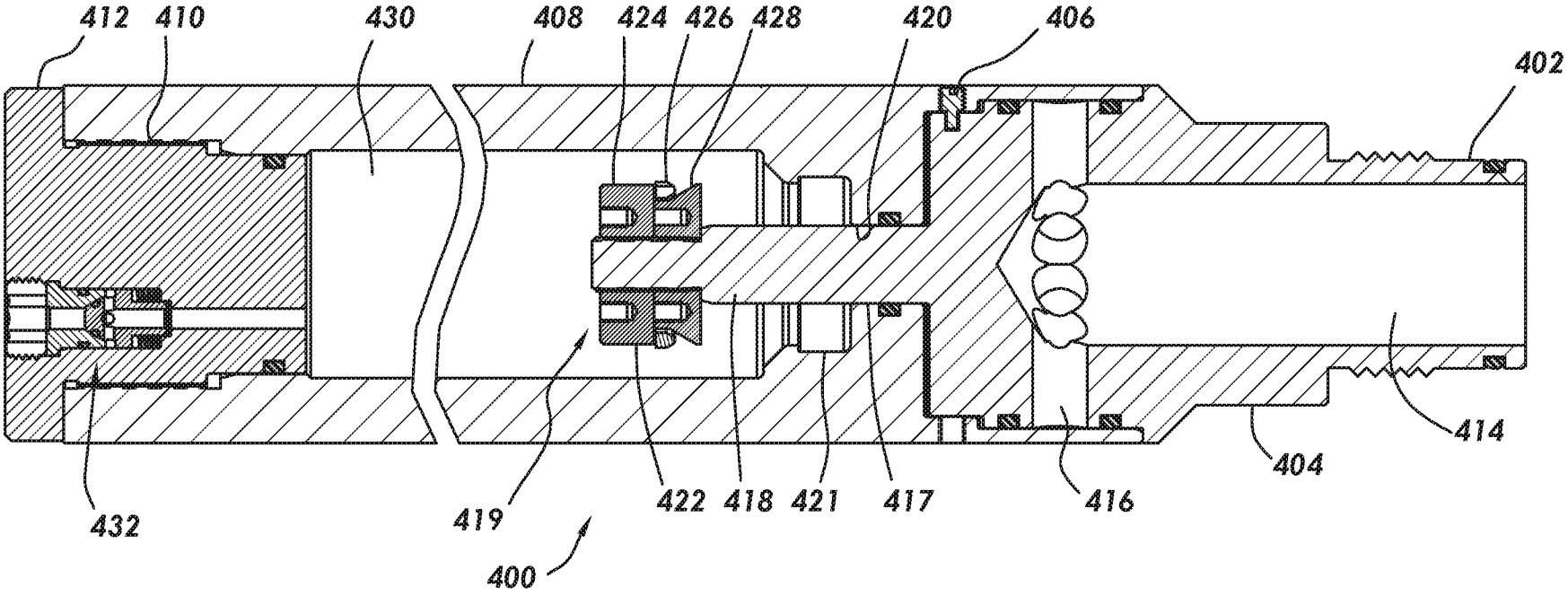
FIG. 8 is a side cross-sectional view of an exemplary valve unit in a run-in position according to aspects of the disclosure.
Figure 9:
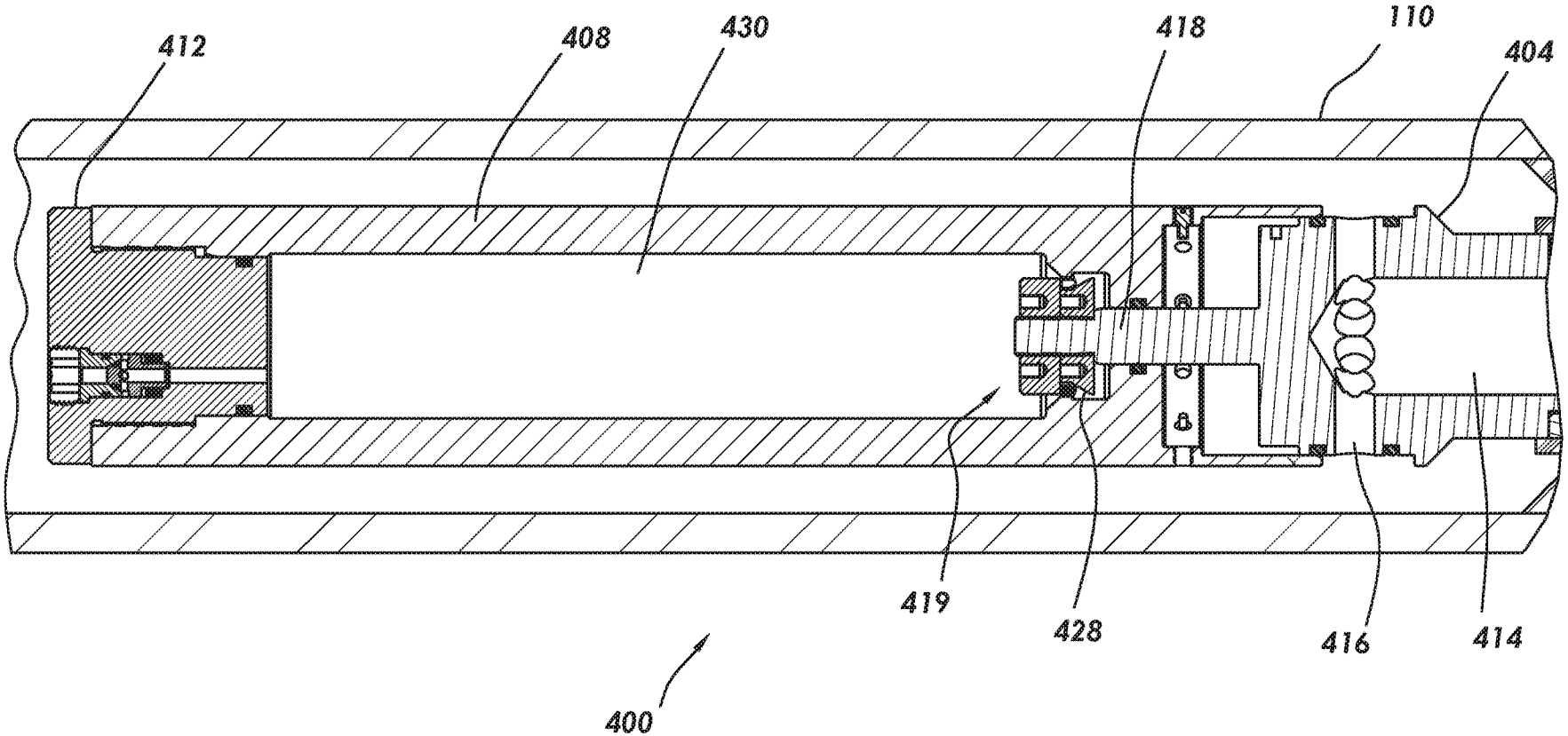
FIG. 9 is a side cross-sectional view of the valve unit of FIG. 8 in an open position according to aspects of the disclosure.

Another embodiment according to aspects of the disclosure is seen at FIGS. 8-9. FIG. 8 is a side, cross-sectional view of an exemplary valve unit 400 in a run-in position. FIG. 9 is a side cross-sectional view of the valve unit of FIG. 8 in an open position. The valve unit 400 may be used as part of a plug assembly, that is, attached at its base 402 to a corresponding plug unit, such as that seen in FIG. 1 at plug unit 180.

The valve unit 400 comprises a lower body 404 removably attached, such as at shearable members 406, to a sleeve 408. The sleeve 408 is fixedly attached, such as at threaded connection 410 to an upper body 412.

The lower body 404 defines a longitudinal bore 414 which provides fluid communication below the valve unit, such as to a corresponding bore in a plug unit. The lower body 404 includes one or more radial ports 416 fluidly connected to the bore 414. The radial ports 416 are initially blocked by the sleeve 408 when the unit is in the run-in position, as seen in FIG. 8. The lower body 404 and sleeve 408 are selectively axially movable with respect to one another. The lower body 404 therefore connects to the sleeve at an axially movable connection 417. An exemplary connection is seen in in that the lower body has a stem 418 extending through a cooperating stem bore 420 of the sleeve 408, wherein the stem is slidable in the bore when the sleeve is released from the lower body.

In some embodiments, the sleeve 408 detaches from, and is no longer connected to, the lower body 404 upon axial movement of the sleeve. In the embodiment shown, the sleeve 408 moves axially with respect to the lower body 404 upon release of the sleeve from the lower body but is retained to the lower body by a retention assembly 419, preventing the released sleeve from floating free in the wellbore. To that end, an exemplary retention assembly 419 includes an upper end of the stem 418 connected to a retention device 422. The exemplary retention device 422 in the embodiment shown comprises a lock nut 424, lock ring 426 and washer 428, attached to the stem 418, for example, at a threaded connection. The retention device 422 prevents the sleeve 408 from completely disconnecting from the lower body 404 and floating free when the sleeve 408 is selectively released from the lower body 404 at shearable members 406. The retention assembly 419 may further include a recess 421 defined in the sleeve 408 which cooperates with the lock ring 428 to attach the sleeve to the retention assembly upon movement of the sleeve 408 to the open position as seen in FIG. 9.

The sleeve 408 comprises a generally tubular wall 440 defining an interior chamber 430. The interior chamber 430 is capable of holding against pressure and is plugged at its ends by the lower and upper bodies 404 and 412, respectively. In the embodiment shown, no biasing mechanism is provided to assist in moving the sleeve axially upon release of the sleeve upon shearing of the shearable members 406. In some embodiments, a biasing element, such as a coil spring or the like, can be used.

The upper body 412 includes a one-way valve sub-assembly providing one-way fluid communication from above the valve unit 400 to the interior chamber 430. Upon a pressure differential across the upper body 412, a higher pressure above the chamber results in pressuring up the chamber. In case of a pressure differential wherein the chamber pressure is higher, the pressure is not transmitted to above the unit but is retained in the chamber. Exemplary one-way valve assemblies are discussed herein with reference to valve sub-assemblies 230*a-b*. In some embodiments, a thermal relief valve (not shown) may be positioned to allow fluid communication from the chamber to prevent damage to the valve unit due to thermal expansion and pressure build-up in the chamber.

In use, the valve unit 400, attached to a plug unit as part of a plug assembly, is dropped or pumped downhole in a casing, pushing a wellbore fluid, such as cement, ahead of the assembly. If pressure above the plug exceeds pressure in the chamber 408, the one-way valve 432 communicates pressure into the chamber, where the pressure remains trapped. The plug assembly lands at the bottom of the casing on a previously lowered plug assembly or float shoe, such as seen in FIG. 4. Upon landing, the pressure in the casing above the valve unit is equal to the pressure in the chamber. Upon bleed-down of the pressure above the valve unit, the pressure in the valve chamber remains unchanged. During casing integrity testing, the pressure in the casing above the valve unit is increased. If casing pressure exceeds chamber pressure, the pressure in the chamber is increased through fluid and pressure communication across the one-way valve sub-assembly 432. Upon pressure bleed-down after the integrity test, the chamber pressure remains high while the pressure above the valve unit drops. The increase in pressure differential between the chamber and casing above creates a piston effect, applying force against the shearable members 406 and shearing the members.

Upon shearing of the members 406, the sleeve 408 moves axially upwards with respect to the lower body 404 into the open position seen in FIG. 9, thereby opening ports 416 and equalizing pressure above the valve unit and below the valve unit. The sleeve 408 continues upward movement until it is stopped by the retention assembly 419. In the embodiment shown, the sleeve 408 is then retained in the open position by cooperation of the lock ring 428 and recess 421. The elevated pressure within the chamber 430 also works to move the sleeve into the open and retained position.

Use of the exemplary plug assemblies herein results, upon release of the sleeve assembly, fluid communication from the casing above the unit, through any intervening plug assemblies and float assembly, to the wellbore below the float assembly, and thence into the formation. Thus it is possible to pump fluids into the wellbore and formation, such as for injection operations. Further, the plug assembly, once in the open position, allows for pump-down of later-used tools, such as a perforation assembly. During pump-down of later tool assemblies, pressure build-up below the assembly is allowed to bleed-off through the one-way valves of the float assembly and into the wellbore or formation, for example.

The disclosed embodiments include a plug assembly for use in a wellbore, comprising: a plug unit having a longitudinal bore extending therethrough, the plug unit for scalingly engaging the wellbore; a valve unit having: a valve body with at least one radial port for fluid communication between the longitudinal bore of the plug unit and an exterior of the plug assembly above the plug unit; an external valve sleeve slidably attached to the valve body and axially movable between a closed position wherein fluid communication through the at least one radial port is prevented and an open position wherein fluid communication through the at least one radial port is permitted; a valve chamber for retaining fluid pressure; a first one-way valve sub-assembly providing pressure communication from the exterior of the plug assembly above the plug unit to the valve chamber, the external valve sleeve movable to the open position in response to a pressure differential between the valve chamber and the exterior of the plug assembly above the plug unit. Further embodiments supported by the disclosure include a plug assembly having any, some or all of the following elements, in any combination: a second one-way valve sub-assembly configured to provide pressure communication into the valve chamber from the longitudinal bore of the plug unit; wherein the first valve sub-assembly is positioned in a stem extension of the valve body; wherein the valve chamber comprises an annular valve chamber defined between the stem extension and the external valve sleeve; wherein the first valve sub-assembly is disposed in a bore defined in the stem extension; wherein the external valve sleeve is attached to the valve body by a shearable member, and wherein the external valve sleeve moves to the open position upon shearing of the shearable member; a biasing member biasing the external valve sleeve towards the open position; wherein in the open position the external valve sleeve is retained to the valve body by a retention assembly; wherein the retention assembly comprises a lock ring which cooperates with a recess defined in the external valve sleeve when the external valve sleeve moves to the open position; and/or wherein the external valve sleeve is detached from the valve body open movement to the open position.

The disclosure is provided in support of the methods claimed or which may be later claimed. Specifically, this support is provided to meet the technical, procedural, or substantive requirements of certain examining offices. It is expressly understood that the portions of the methods disclosed and claimed can be performed in any order, unless otherwise specified or necessary, that each portion of the method can be repeated, performed in orders other than those presented, that additional actions can be performed between the enumerated actions, and that, unless stated or claimed otherwise, actions can be omitted or moved. Those of skill in the art will recognize the various possible combinations and permutations of actions performable in the methods disclosed herein without an explicit listing of every possible such combination or permutation. It is explicitly disclosed and understood that the actions disclosed herein can be performed in various orders (xyz, xzy, yxz, yzx, etc.) without writing them all out.

The disclosure supports the following methods, such as a method of performing an operation in a tubular disposed in a wellbore, comprising: running a plug assembly down the tubular, the plug assembly pushing a fluid in the tubular ahead of the plug assembly; stopping the plug assembly in the tubular at a location downhole in the wellbore; increasing fluid pressure above the plug assembly; communicating the pressure increase through a one-way valve sub-assembly into a valve chamber defined in the plug assembly; reducing fluid pressure in the tubular above the plug assembly, creating a pressure differential between the valve chamber and the tubular above the plug assembly; axially moving an external valve sleeve on the plug assembly in response to the pressure differential; and in response to moving the valve sleeve, opening fluid communication between the tubular above the plug assembly and the tubular below the plug assembly. Further methods supported by the disclosure include a plug assembly having any, some or all of the following additional actions, in any combination: communicating pressure from the tubular below the plug assembly to the valve chamber through a one-way valve sub-assembly; wherein stopping the plug assembly further comprises landing the plug assembly on a downhole collar; wherein increasing the fluid pressure above the plug assembly further comprises running an integrity test of the tubular; wherein reducing fluid pressure above the plug assembly further comprises bleeding off pressure following the integrity test; at least one shearable member attaching the external sleeve to a valve body, and wherein moving the external sleeve further comprises shearing the at least one shearable member; after moving the external valve sleeve and opening fluid communication between the tubular above and below the plug assembly, retaining the external sleeve on a valve body of the plug assembly; wherein retaining the external sleeve further comprises attaching the external sleeve to a retention mechanism on the valve body; urging the external sleeve towards the open position with a biasing member; and/or wherein pushing a fluid ahead of the plug assembly further comprises pushing cement ahead of the plug assembly and into an annulus defined outside the tubular.

The embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims.

It is claimed:

1. A plug assembly for use in a wellbore, comprising:

a plug unit having a longitudinal bore extending therethrough, the plug unit for sealingly engaging the wellbore;

a valve unit having:

a valve body with at least one radial port for fluid communication between the longitudinal bore of the plug unit and an exterior of the plug assembly above the plug unit;

an external valve sleeve slidably attached to the valve body and axially movable between a closed position wherein fluid communication through the at least one radial port is prevented and an open position wherein fluid communication through the at least one radial port is permitted;

a valve chamber for retaining fluid pressure;

a first one-way valve sub-assembly providing pressure communication from the exterior of the plug assembly above the plug unit to the valve chamber, the external valve sleeve movable to the open position in response to a pressure differential between the valve chamber and the exterior of the plug assembly above the plug unit.

2. The plug assembly of claim 1, further comprising a second one-way valve sub-assembly configured to provide pressure communication into the valve chamber from the longitudinal bore of the plug unit.

3. The plug assembly of claim 1, wherein the first valve sub-assembly is positioned in a stem extension of the valve body.

4. The plug assembly of claim 3, wherein the valve chamber comprises an annular valve chamber defined between the stem extension and the external valve sleeve.

5. The plug assembly of claim 4, wherein the first valve sub-assembly is disposed in a bore defined in the stem extension.

6. The plug assembly of claim 1, wherein the external valve sleeve is attached to the valve body by a shearable member, and wherein the external valve sleeve moves to the open position upon shearing of the shearable member.

7. The plug assembly of claim 6, further comprising a biasing member biasing the external valve sleeve towards the open position.

8. The plug assembly of claim 1, wherein in the open position the external valve sleeve is retained to the valve body by a retention assembly.

9. The plug assembly of claim 8, wherein the retention assembly comprises a lock ring which cooperates with a recess defined in the external valve sleeve when the external valve sleeve moves to the open position.

10. The plug assembly of claim 1, wherein the external valve sleeve is configured to detach from the valve body upon movement to the open position.

11. A method of performing an operation in a tubular disposed in a wellbore, comprising:

running a plug assembly down the tubular, the plug assembly pushing a fluid in the tubular ahead of the plug assembly;

stopping the plug assembly in the tubular at a location downhole in the wellbore;

increasing fluid pressure above the plug assembly;

communicating the pressure increase through a one-way valve sub-assembly into a valve chamber defined in the plug assembly;

reducing fluid pressure in the tubular above the plug assembly, creating a pressure differential between the valve chamber and the tubular above the plug assembly;

axially moving an external valve sleeve on the plug assembly in response to the pressure differential; and in response to moving the valve sleeve, opening fluid communication between the tubular above the plug assembly and the tubular below the plug assembly.

12. The method of claim 11, further comprising communicating pressure from the tubular below the plug assembly to the valve chamber through a one-way valve sub-assembly.

13. The method of claim 11, wherein stopping the plug assembly further comprises landing the plug assembly on a downhole collar.

14. The method of claim 11, wherein increasing the fluid pressure above the plug assembly further comprises running an integrity test of the tubular.

15. The method of claim 14, wherein reducing fluid pressure above the plug assembly further comprises bleeding off pressure following the integrity test.

16. The method of claim 14, at least one shearable member attaching the external sleeve to a valve body, and wherein moving the external sleeve further comprises shearing the at least one shearable member.

17. The method of claim 11, further comprising, after moving the external valve sleeve and opening fluid communication between the tubular above and below the plug assembly, retaining the external sleeve on a valve body of the plug assembly.

18. The method of claim 17, wherein retaining the external sleeve further comprises attaching the external sleeve to a retention mechanism on the valve body.

19. The method of claim 11, further comprising urging the external sleeve towards the open position with a biasing member.

20. The method of claim 11, wherein pushing a fluid ahead of the plug assembly further comprises pushing cement ahead of the plug assembly and into an annulus defined outside the tubular.

* * * * *